United States Patent [19]

Govan

[11] Patent Number: 4,954,108

[45] Date of Patent: Sep. 4, 1990

[54] LINE CUTTER FOR MARINE PROPELLERS

[76] Inventor: Donald T. Govan, Box 350246, Fort Lauderdale, Fla. 33335

[21] Appl. No.: 444,997

[22] Filed: Dec. 4, 1989

[51] Int. Cl.[5] ..... B63H 1/28

[52] U.S. Cl. ..... 440/73; 83/929; 416/146 R

[58] Field of Search ..... 440/73; 416/146 B; 83/929

[56] References Cited

U.S. PATENT DOCUMENTS

| | | | |
|---|---|---|---|
| 726,180 | 4/1903 | Miller | 440/73 |
| 1,813,540 | 7/1931 | Laska | 416/146 B |
| 4,447,215 | 5/1984 | Govan | 440/71 |
| 4,507,091 | 3/1985 | Govan | 440/73 |
| 4,544,363 | 10/1985 | Govan | 440/73 |
| 4,801,281 | 1/1989 | Govan | 440/73 |

FOREIGN PATENT DOCUMENTS

| | | | |
|---|---|---|---|
| 256544 | 4/1970 | U.S.S.R. | 440/73 |

OTHER PUBLICATIONS

Stripper TM Brochure Ambassador Marine Ltd. "Patented Worldwide".

*Primary Examiner*—Sherman Basinger
*Assistant Examiner*—Thomas J. Brahan
*Attorney, Agent, or Firm*—Alvin S. Blum

[57] ABSTRACT

Apparatus shears foreign matter such as lines, wires, nets and weeds that can entangle and befoul propellers, propeller shafts, bearings and the like of propeller-driven water born vessels. The apparatus shears by cooperative shearing action of rotating blades that rotate in conjunction with the propeller and a non-rotating blade mounted on a non-rotating portion of the vessel. The non-rotating blade is pivotally mounted in a rigid blade holder. A wedge and V-shaped valley mechanism operating between holder and non-rotating blade forces the non-rotating blade toward the rotating blade as the blade pivots when foreign matter is being sheared to overcome forces tending to spread the blades apart. The apparatus is intended for operation in situations where there is negligible axial movement of the shaft.

11 Claims, 3 Drawing Sheets

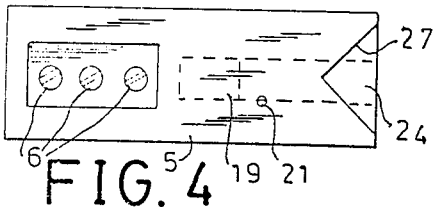
FIG. 4
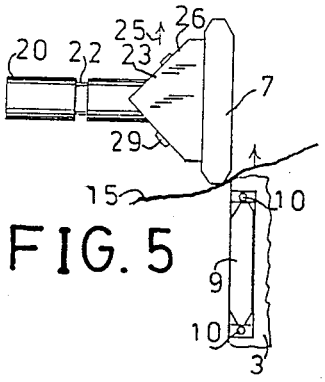
FIG. 5
FIG. 2
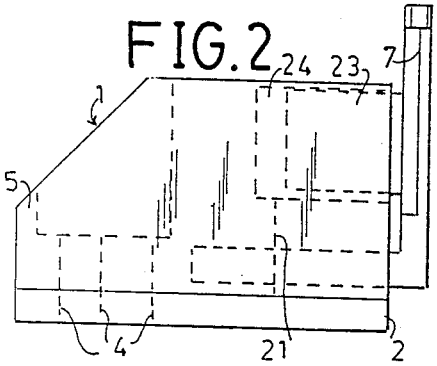
FIG. 3
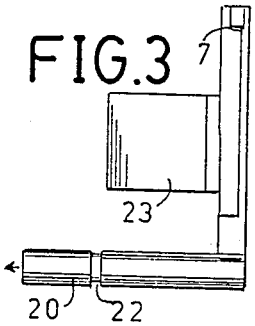
FIG. 10
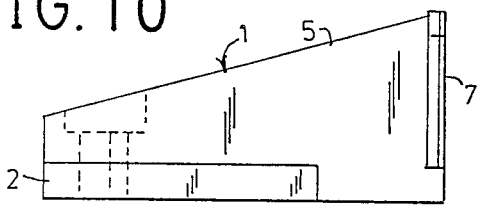
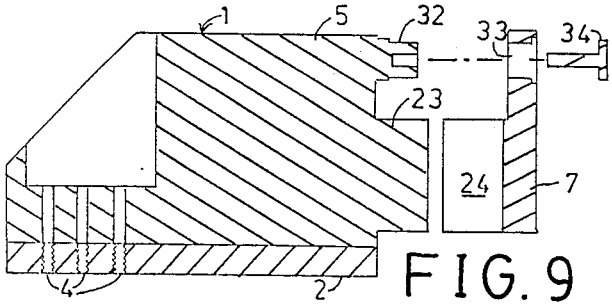
FIG. 9

30
7
23
11
19
1
31
5
2
32
24
34
9

LINE CUTTER FOR MARINE PROPELLERS

BACKGROUND OF THE INVENTION

1. Field of the Invention

This invention relates to devices that cut lines, weeds, nets and the like, and more particularly to shearing cutters that employ a blade rotating with the propeller and shaft of a vessel that cooperates with a non-rotating blade mounted on a non-rotating portion of a vessel adjacent the shaft wherein there is negligible axial movement of the shaft.

2. Description of the Prior Art

Since all of the forces to drive a vessel are transmitted from the propeller to the vessel by axial forces on the shaft, the ordinary marine drive experiences considerable axial movement of the shaft from full forward power to full reverse.

U.S. Pat. Nos. 4,447,215; 4,507,091; 4,544,363 and 4,801,281 have been issued to the Applicant for shearing cutters in which both rotating and non-rotating blades are carried on the shaft so that axial movement of the shaft will not influence the spacing between the blades. Copending patent application Ser. No. 07/392,542 relates to a shearing cutter system in which the non-rotating blade is mounted on the non-rotating propeller shaft housing with a means for moving the non-rotating blade forward or aft to compensate for axial movement of the rotating blade to maintain a shearing spacing between the blades.

There are certain propeller drive systems that have negligible axial displacement of the propeller shaft. These are exemplified by the Arneson*drive. None of the line shearing cutting devices of the prior art have been provided for these drives that take advantage of their unique requirements for economy and efficiency of structure and function.

*Arneson Surface Drives TM
Arneson Marine Inc.
2850 N.E. 187th St.
No. Miami Beach, Fla. 33180

SUMMARY OF THE INVENTION

It is accordingly an object of the invention to provide a shearing cutter system for marine propeller drives that have minimal axial displacement of the propeller shaft. It is yet another object to provide a cutter with at least one blade that rotates with the propeller and at least one non-rotating blade connected to the propeller housing that does not rotate for shearing action between the two blades. The shearing action between the two blades cuts foreign matter that is caught by the propeller. This prevents its winding around the shaft and propeller where it would interfere with the operation of the vessel.

It is yet another object of the invention to provide a system which forces the shearing blades together when foreign matter is caught between them for more effective operation.

It is yet another object of the invention to provide a shearing system that can operate effectively without bearings or mechanisms for sensing and adjusting the distance between blades to reduce costs of manufacture and maintenance.

It is yet another object to provide apparatus that can be maintained from the water surface.

The invention provides one or more rotating blades that rotate with the shaft and propeller. These blades have a flat forward face extending radially in a plane perpendicular to the axis of the shaft. Each blade has a pair of radially disposed shearing edges bounding the flat face so that shearing will occur with either forward or reverse rotation.

The non-rotating blade has a matching planar face with paired, radially disposed shearing edges for cooperating with the rotating blade. The non-rotating blade is attached to the propeller shaft housing by a blade support. The blade is held in the support by a pivotal mounting that enables the blade to pivot about an axis parallel to the shaft axis through an angle of less than 20 degrees. As the blade pivots, a wedge, fixedly connected to the blade, interacts with a V-shaped recess in the support to force the blade toward the rotating blades. This pivoting motion is activated by material caught between the blades and is the mechanism by which the two blades remain close enough for effective shearing despite forces that tend to spread them apart.

These and other objects, features and advantages of the invention will become more fully apparent when the following detailed description of preferred embodiments of the invention are read in conjunction with the accompanying drawings.

BRIEF DESCRIPTION OF THE DRAWINGS

FIG. 2 is a side elevation view of the non-rotating cutter of FIG. 1.

FIG. 3 is a side elevation view of the non-rotating cutter blade of FIG. 2 removed from its support showing its relationship to a rotating blade.

FIG. 4 is a top view of the support of FIG. 2.

FIG. 5 is a top view of the blade of FIG. 3.

FIG. 9 is a sectional view taken on the line 9—9 of FIG. 8.

FIG. 10 is a side elevation view of the non-rotating blade of an alternative embodiment of the invention in which the blade does not pivot.

DETAILED DESCRIPTION OF PREFERRED EMBODIMENTS OF THE INVENTION

Figure 1:
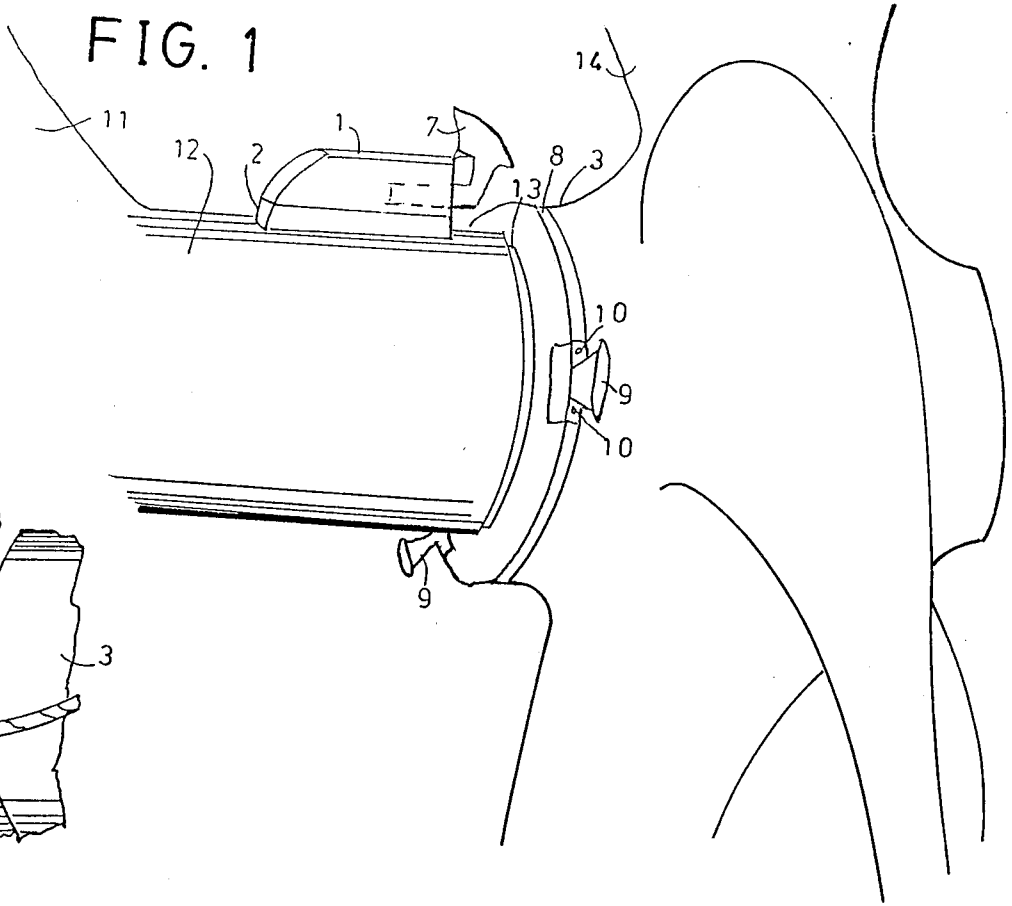
FIG. 1 is a perspective view of the cutter of the invention in place on a vessel.
Figure 12:
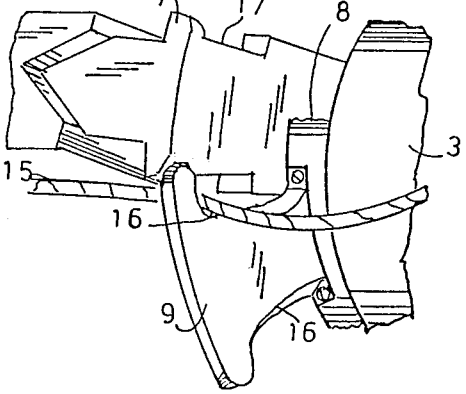
FIG. 12 is a partial perspective view of the two blades in shearing position.

Referring now first to FIGS. 1–5 and 12, a vessel 11 has a propeller shaft housing 12. A propeller shaft 13 carrying propeller 14 is journalled in the shaft housing 12. A metal ring 8 is attached either to the shaft 13 or the propeller hub 3 so as to rotate with the propeller 14. Rotating blades 9 are bolted into recesses in ring 8 by bolts 10 as best seen in FIG. 1 so that they may be serviced from the water surface for easy maintenance. Alternatively, as shown in FIG. 5, the rotating blades 9 may be mounted directly in recesses formed in the propeller hub 3. The blades extend radially beyond the hub 3. When the rotating propeller encounters a rope, net, fishing line or the like, a propeller blade will engage it and wind it around the shaft 13 and may cut into the bearing between shaft and shaft housing as well as interfering with efficient propeller operation. With the invention in place, as best seen in FIG. 12, the propeller blades will catch the foreign matter 15 as they turn and twist it inward where it will be caught by the rotating blades 9 and forced against the non-rotating blade 7. These two blades have flat cooperating faces that are very close together, e.g. 0.005 inches apart, arranged in planes perpendicular to the axis of the shaft 13. One of the sharp shearing edges 16 of blade 9 cooperates with one of the sharp shearing edges 17 of blade 7 to cut through the foreign matter 15.

The non-rotating blade assembly is rigidly secured to the propeller shaft housing 12 on its upper aspect so that it may be serviced from the water surface. A plate 2 is fastened to housing 12 preferably by welding. Plate 2 has three threaded holes 4. Blade holder block 5 is bolted to the plate 2 by three bolts 6. These bolts may serve as shear pins to release the assembly 1 when foreign matter too hard to cut is encountered. Blade holder block 5 holds non-rotating blade 7 by means of a cylindrical hole 19 formed in the block with an axis parallel to the shaft axis. The blade 7 has a rod 20 that fits rotatably in the hole 20 in block 5. A locking pin 21, holds rod 20 rotatably in hole 19. The purpose of holding blade 7 pivotally in the block 5, is to provide for an inclined plane action to overcome forces that tend to spread the blades apart at the moment of shearing. When cutting a heavy cord with scissors, there is a tendency for the blades to be forced apart. When this happens, the cutting effect is lost. This is what is overcome by the action of the wedge 23 attached to blade 7 that fits in the V-shaped recess 24 on block 5. As best seen in FIGS. 4 and 5, when rotating blade 9 forces rope 15 against blade 7, blade 7 pivots about rod 20 in the direction of arrow 25. The sloping face 26 of wedge 23 is forced against the sloping face 27, forcing blade 7 toward blade 9, thereby resisting forces pushing them apart. Rubbery pads 29 may optionally be provided on the wedge to maintain the wedge centrally in the recess when not shearing.

Figures 6, 7, 8, 11:
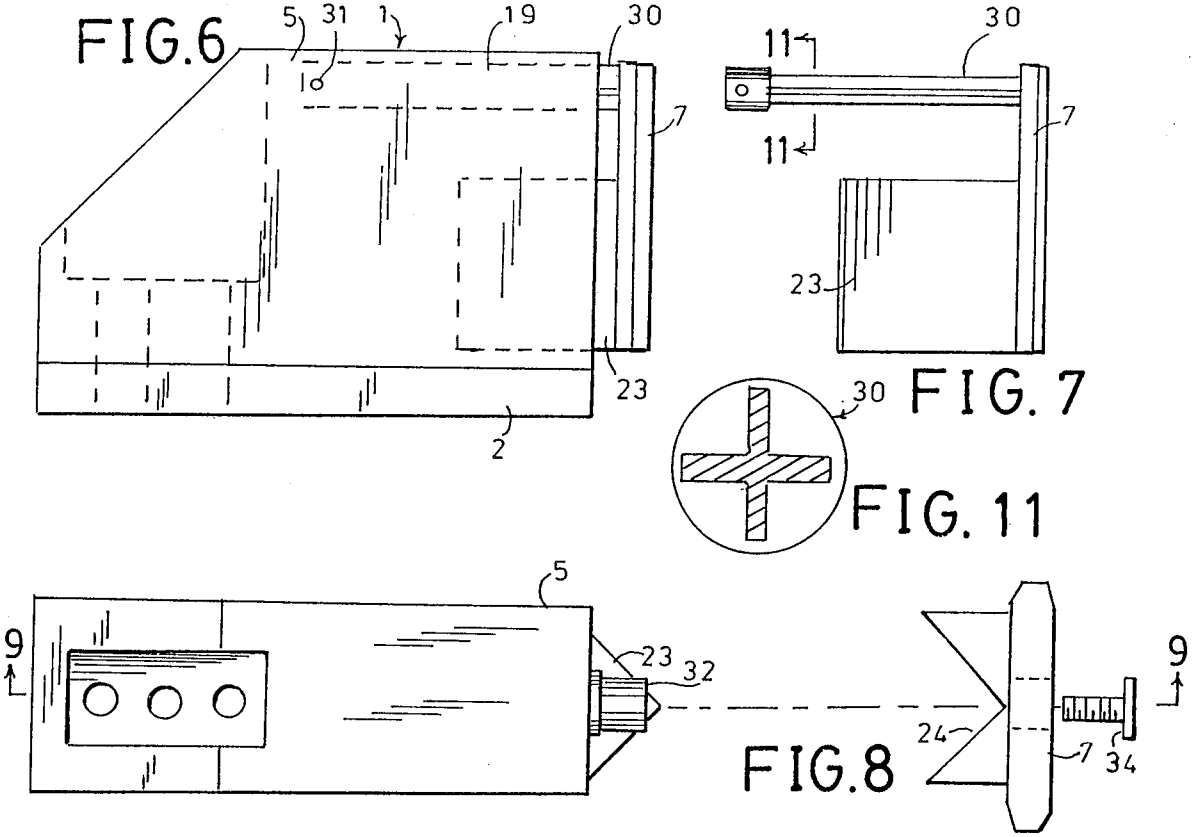
FIG. 6 is a side elevation view of the non-rotating blade assembly of an alternative embodiment of the invention.
FIG. 7 is a side elevation view of the blade of FIG. 6.
FIG. 8 is an exploded top view of an alternative embodiment of the invention.
FIG. 11 is a sectional view taken on the line through 11—11 of FIG. 7.

In the alternative embodiment shown in FIGS. 6,7 and 11, the wedge 23 is below the pivot member 30. In this embodiment the pivot member 30 is a torsion bar that fits in cylindrical hole 19 in block 5 and is pinned in place by locking pin 31. As shown in FIG. 11, the cross sectional shape torsion bar 30 is arranged for easy rotation while resisting lateral motion.

In the alternative embodiment shown in FIGS. 8 and 9, the V-shaped recess is attached to the non-rotating blade 7 and the wedge 23 is attached to the block 5. The pivoting action is achieved by a post 32 attached to the block 5 engaging a hole 33 in blade 7. Bolt 34 retains the blade 7 pivotally on the post 32.

The shape of the rotating and non-rotating blades may employ any of the shapes well known in the art as desired.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

What is claimed is:

1. An apparatus that cuts foreign matter including lines, wires, nets and weeds of the type that may be encountered by propeller driven vessels when under way, said vessels of the type where the propeller is mounted to a rotatable propeller shaft that extends from a propeller shaft housing connected to the vessel's hull, and in which there is negligible axial movement of said shaft, said apparatus comprising:

(A) at least one first blade means for cutting, said first blade means having a first shearing plane, said first blade means arranged to rotate in conjunction with said propeller with said first shearing plane substantially perpendicular to the axis of said shaft;

(B) first support means for supporting said first blade means in position extending radially and beyond said first support means to engage said foreign matter, said first support means including means for fixedly attaching to at least one member of the pair consisting of said shaft and said propeller;

(C) at least one second blade means for cutting, said second blade means having a second shearing plane, said second blade means arranged with said second shearing plane substantially parallel to said first shearing plane of said first blade means;

(D) second support means for supporting said second blade means in a position extending radially parallel to, and within shearing distance of, said first blade means to engage said foreign matter for shearing said foreign matter between said first and second blade means, said second support means for fixedly attaching to a non-rotating member of said hull;

(E) said first blade means and said second blade means each having radially extending, sharp edges at two margins of said shearing planes for cutting said foreign matter;

(F) said second support means supporting said second blade means in a pivotal structure arranged to permit said second blade means to pivot about a blade axis parallel to the axis of said shaft;

(G) a combination of a wedge means and a substantially V-shaped valley means for applying force to said second blade means for forcing said second blade means toward said first blade means when said second blade means pivots about said blade axis; and (H) wherein one of said combination of said wedge means and said valley means is connected to said second blade means and the other is connected to said second support means.

2. The apparatus according to claim 1 in which said second support means includes a detachable blade support and a mounting plate means for permanently attaching to said hull, said plate means having fastener receiving means for removably attaching said detachable blade support by removable fasteners, said fasteners radially arranged for ease of maintenance.

3. The apparatus according to claim 1 further comprising resilient member means for resiliently holding said wedge means within said valley means, wherein said resilient member means is mounted between said wedge means and said valley means.

4. The apparatus according to claim 1 including torsion bar means for pivotally holding said second blade means to said second support means.

5. The apparatus according to claim 4 in which said torsion bar means has a substantially cruciform cross section portion for more effective operation.

6. The apparatus according to claim 1 in which said pivotal structure includes a cylindrical post connected to said second blade means and a cylindrical recess in said second support means.

7. The apparatus according to claim 1 in which said pivotal structure includes a cylindrical post connected to said second support means and a cylindrical recess in said second blade means.

8. The apparatus according to claim 1 in which said pivotal structure is closer to said shaft than said wedge means is.

9. The apparatus according to claim 1 in which said wedge means is closer to said shaft than said pivotal structure is.

10. The apparatus according to claim 1 in which said first support means includes a ring having recesses for receiving said first blade means, said recesses having fastener-receiving elements for receiving radially arranged fasteners for removably attaching said first blade means.

11. The apparatus according to claim 1 in which said first support means includes a recess formed in said propeller for receiving each said first blade means, said recess having radially arranged fastener receiving elements for removably attaching said first blade means.

* * * * *